United States Patent [19]

Ogden

[11] 4,196,045

[45] Apr. 1, 1980

[54] METHOD AND APPARATUS FOR TEXTURIZING AND SOFTENING NON-WOVEN WEBS

[75] Inventor: William L. Ogden, Janesville, Wis.

[73] Assignee: Beloit Corporation, Beloit, Wis.

[21] Appl. No.: 892,823

[22] Filed: Apr. 3, 1978

[51] Int. Cl.[2] ..... D21F 3/04

[52] U.S. Cl. ..... 162/117; 162/206; 162/359; 162/360 R

[58] Field of Search ..... 162/117, 116, 115, 113, 162/206, 290, 296, 359, 360 R, 362

[56] References Cited

U.S. PATENT DOCUMENTS

| | | | |
|---|---|---|---|
| Re. 27,453 | 8/1972 | Schutte et al. | 162/116 X |
| Re. 28,459 | 7/1975 | Cole et al. | 162/115 |
| 768,353 | 8/1904 | Waite | 162/362 X |
| 3,020,168 | 2/1962 | Gouveia | 162/362 X |
| 3,230,136 | 1/1966 | Krake | 162/116 X |
| 3,301,746 | 1/1967 | Sanford | 162/113 |
| 3,481,830 | 12/1969 | Hanke | 162/296 |
| 3,629,056 | 12/1971 | Forrest | 162/362 X |
| 3,812,000 | 5/1974 | Salvucci, Jr. et al. | 162/290 X |
| 3,821,068 | 6/1974 | Shaw | 162/290 X |
| 3,994,771 | 11/1976 | Morgan, Jr. et al. | 162/113 |
| 4,087,319 | 5/1978 | Linkletter | 162/113 |

*Primary Examiner*—Richard V. Fisher

*Attorney, Agent, or Firm*—D. J. Veneman; G. A. Mathews; M. L. Gill

[57] ABSTRACT

A method and apparatus for texturing, softening and building bulk into a non-woven fabric web, such as tissue or toweling paper, wherein the paper is passed through a plurality of nipped rolls while interposed between a pair of screens. In the preferred embodiment, each screen is comprised of metal and plastic shute and warp strands, respectively. The web is passed through a first texturing nip while wet and then dried before passing through subsequent nips to effect the texturing and softening of the web.

11 Claims, 14 Drawing Figures

METHOD AND APPARATUS FOR TEXTURIZING AND SOFTENING NON-WOVEN WEBS

BACKGROUND OF THE INVENTION

In some light grades of paper, such as tissue/toweling, it is desirable, perhaps even necessary, to have a certain degree of bulk and softness for consumer acceptance. A problem in manufacturing such paper is to impart both softness and bulk in the paper without sacrificing too much strength and to do all this at the operating speeds of papermaking machines, which for tissue making machines can approach 5,000 ft/min.

Previously, bulk and softness in paper has been provided by two primary methods. The first consists of passing the web through a pair of nipped rolls, each having its surface engraved with a desired pattern, such as a checked grid. This is an off-machine process wherein a roll of tissue paper is run through the rolls after it has been removed from the papermaking machine. The second method consists of passing the web through a pair of nipped rolls with one or more continuous looped wire screens or so-called imprinting fabrics. The screen then imparts bulk and often a permanent pattern in the web as its knuckles deform a local area. Sometimes, the screens themselves form the outer peripheral cover of the rolls as shown in U.S. Pat. Re. No. 27,453.

However, engraving patterns on roll surfaces is expensive. Further, when I have tried to soften a web by passing it through a pair of nipped rolls while held between a pair of ordinary wire (i.e. bronze) screens, I have found that the nip pressure required to accomplish any significant degree of softening is so high that the wires tend to crush and tear the web to an extent that thin spots and even holes are formed, thus weakening the web and rendering it a less desirable product.

On the other hand, I have found that any attempt to use screens made of all-plastic wires does not produce good bulk or softness in the web regardless of the nip pressures used because the all-plastic wire screens tend to flatten out to such an extent that the deformation of the knuckles into the paper web is too little to build the desired bulk and softness.

Heretofore, on-machine tissue bulk building and softening was, and is, accomplished by applying the wet web onto a Yankee dryer where it literally sticks on the surface until it is doctored off near the bottom of its single revolution thereon. Doctoring the dried web off the surface breaks some of the hydrogen bonds in the web and thereby imparts a degree of softness. This works well enough, but even though these so-called Yankee machines are fast (at least one has produced tissue paper at 5,000 fpm) they are speed limited and becoming very costly. At today's prices, the Yankee dryer itself costs well over a million dollars and there are no manufacturers in the U.S. Further, there are limits to the diameter which Yankee dryers can be cast, machined, transported and installed. Since the web must be completely dry by the time it is doctored off, the diameter imposes a speed limitation on a Yankee-type machine. Finally, the dried web cannot be applied to a subsequent dryer and doctored off because it will not stick to the dryer roll surface. Besides, even if the dried and once-doctored web did stick to a subsequent dryer roll surface, a second doctoring would almost always damage the web whether or not it softened the web further. Thus, it is seen that producing bulky and softened tissue on a Yankee type machine has its limitations.

SUMMARY OF THE INVENTION

This invention produces a paper web having high bulk and softness by first passing a web having a moisture content of about 40%–80%, preferably 60%–70%, through a pair of nipped rolls while held between a pair of opposed screens, drying the web to substantially air dry, then passing the web through a plurality of relatively light nips while between the opposed screens. This first-nip-while-the-web-is-wet texturing operation can be applied on or off the papermaking machine. If done on the papermaking machine, it is done at a location where the web still has about 40%–80% moisture, such as in, or just after, the press section. The web is then passed through a dryer section before subsequent texturing is done on the dry web. Alternately, the web can be rewet, such as by showers, particularly if the operation is done off-machine, to bring the moisture up to a desired level before the initial wet texturing nip. It would then be redried before the dry texturing steps. By texturing the web once while it is still about 40%–80% moisture, the fibers are deformed before their hydrogen bonds become set. I have found that such initial, brief wet texturing imparts a bulk to the web that remains substantially intact through subsequent texturing operations when the web is more dry. Further, the subsequent dry texturing does not weaken the web to an extent where it is unacceptable by my standards which will be defined presently. Possibly, under certain conditions, such as type of fiber and moisture level, even fibers which have been set might be moved by the knuckles and later become reset in new positions. This allows the deformation of the texturing process to be imparted without tearing or puncturing the web.

This combination of high strength, bulk and softness is achieved by interposing the web between a pair of opposed screens, each being comprised of either all metal wires or, preferably, plastic warp wires and metal shute wires during the wet and dry texturing process. I have found that such an arrangement of wire strands provides good knuckles in particular in the plastic warp wires which deform the web fibers enough to sufficiently texture the paper web to produce softness and bulk without creating thin spots or holes in the web. Further, since the metal wires have greater stiffness than the plastic wires, they do not kink easily and more or less remain straight so the plastic wires bend more sharply as they are wrapped around the relatively non-yielding metal shute wires. The plastic warp wires also flatten out slightly at the apex (i.e. knuckle) of their curvature over the shute wires. Thus, while the warp wires still define good penetration into the paper web against which it is bearing, the knuckle itself is relatively blunt, as compared to a knuckle in a metal wire of the same diameter, due to its flattening over the comparatively stiff, unkinked metal shute wire.

Since the metal shute wires extend in the cross machine direction in the combination metal/plastic wire screen, they undergo very little flexing in mechanical working as they travel along their looped paths so their life is correspondingly longer than if they were utilized in the longitudinal position as warp wires.

Although the combination metal/plastic wire screens are preferred because of their longer life and good results, I have found that all-metal wire screens also provide satisfactory results in building bulk and imparting softness when used in the manner I have conceived. I believe this due in large part to the combination to the wet, then dry treatment, both at relatively light nip pressures loadings (i.e. not exceeding about 50 PLI wet nip and about 35 PLI dry nip). An all-metal wire screen could be used with a combination metal/plastic wire screen.

It has further been found that when the opposed wire screens are separated as they travel between each of a plurality of nipped rolls, they tend to come back together in slightly different relative positions against the paper web as they travel through the next nipped roll couple. Thus, the knuckles on either side of the interposed web bear against both the interposed web and the other screen at a slightly different location so that the knuckles of one wire screen deform a different location on the web as the knuckles push into the interstices between wire strands in the other screen as they are brought together in the nip. After traveling through several such nips, the fibers have been worked more than once and the web is textured equally on both sides and uniformly over its entire surface.

Accordingly, it is an object of this invention to provide a method and apparatus for texturing a non-woven web while it is both wet and dry to provide greater bulk and softness while retaining web strength.

It is another object of this invention to provide apparatus for softening and building bulk into a web which utilizes at least one screen wherein the warp and shute wires are of dissimilar materials.

It is another object of this invention to provide a more efficient method and apparatus for building bulk and softness into a non-woven web.

It is still another object of this invention to provide a method and apparatus for softening and imparting bulk to a paper web without requiring crepe doctoring from a dryer.

It is another object of this invention to provide a method and apparatus integral with the papermaking machine for imparting bulk and softness to a paper web.

An object and feature of this invention is that the web is softened and its bulk increased regardless of how the web has been dried.

These and other objects, features and advantages of this invention will become apparent to those skilled in the art when the attached figures are viewed in conjunction with the description of the preferred embodiments.

DESCRIPTION OF THE PREFERRED EMBODIMENTS

Before describing the preferred embodiments, some of the terms used herein should be defined or clarified to more clearly understand the invention. In the prior art, when various apparatus and processes are described, the terms "embossing" and "texturing" are often used more or less interchangeably. In this invention, "embossing" will refer to the treating or marking of paper webs by passing them through a pair of nipped rolls which have patterns engraved or otherwise formed in their surfaces so that the web is treated as it passes through. In "embossing", the primary purpose of the treatment is to impart a pattern, often decorative, in the web, although the web may be softened or made bulkier as a secondary effect.

In "texturing", the web is passed through a pair of nipped rolls together with a screen or a pair of opposed screens, one on either side of the web. The strands in the screens are pressed into the web and provide the desired working of the web. The primary purpose is to soften the web and make it bulkier so that it has a more desirable drape and feel. A secondary consideration, if it is desired at all, is to impart a decorative pattern into the web. Sometimes, little or no decorative pattern remains in the web after being "textured".

Figure 1A:
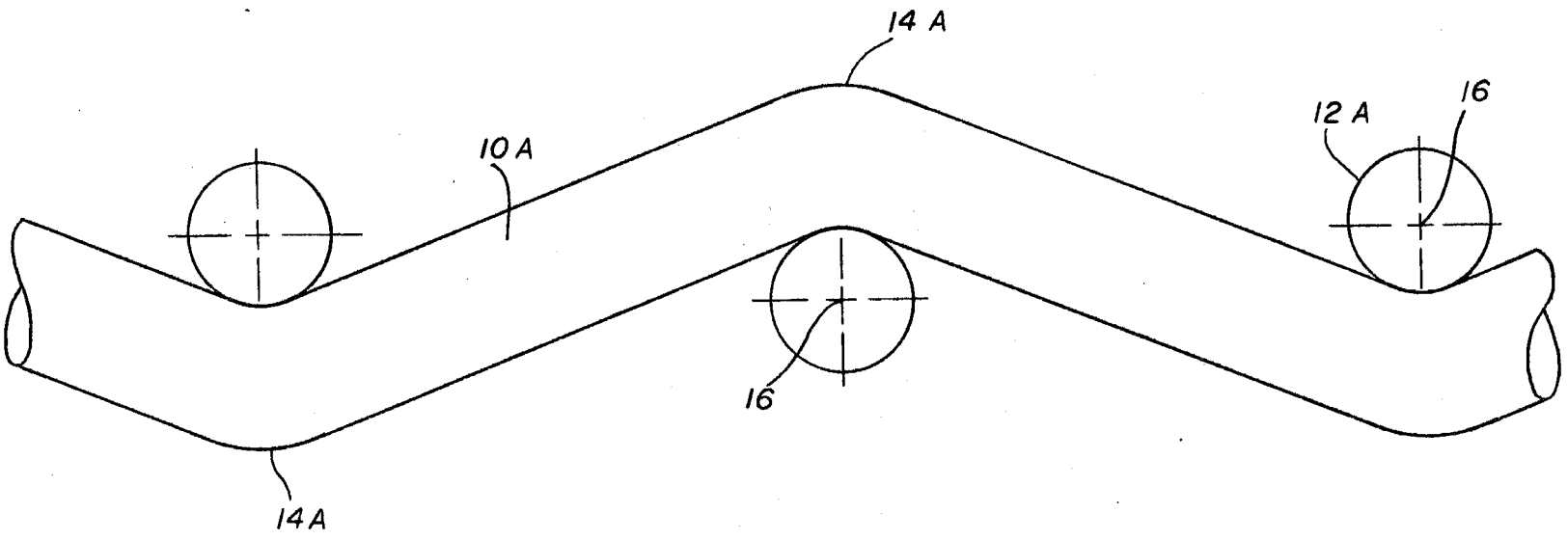
FIG. 1 A PRIOR ART
FIG. 1A is an end view of an ordinary all-metal wire screen.

FIG. 1A shows what might be called a common wire screen similar to that used in a house window or as the Fourdrinier wire on a papermaking machine. In this invention, when the screen is in operating position, the wires extending in the cross machine direction are called shute wires 12A and the wires extending in the machine direction are called warp wires 10A. The warp wires extend in a serpentine path through the shute wires which are offset along the path of the warp wires due to their own serpentine path in the cross machine direction. Each warp wire has a knuckle 14A which lies substantially in the plane defined by a line along the outer surface of a shute wire parallel to the wire's longitudinal axis 16 in a corresponding line in the adjacent warp wire.

Figure 1B:
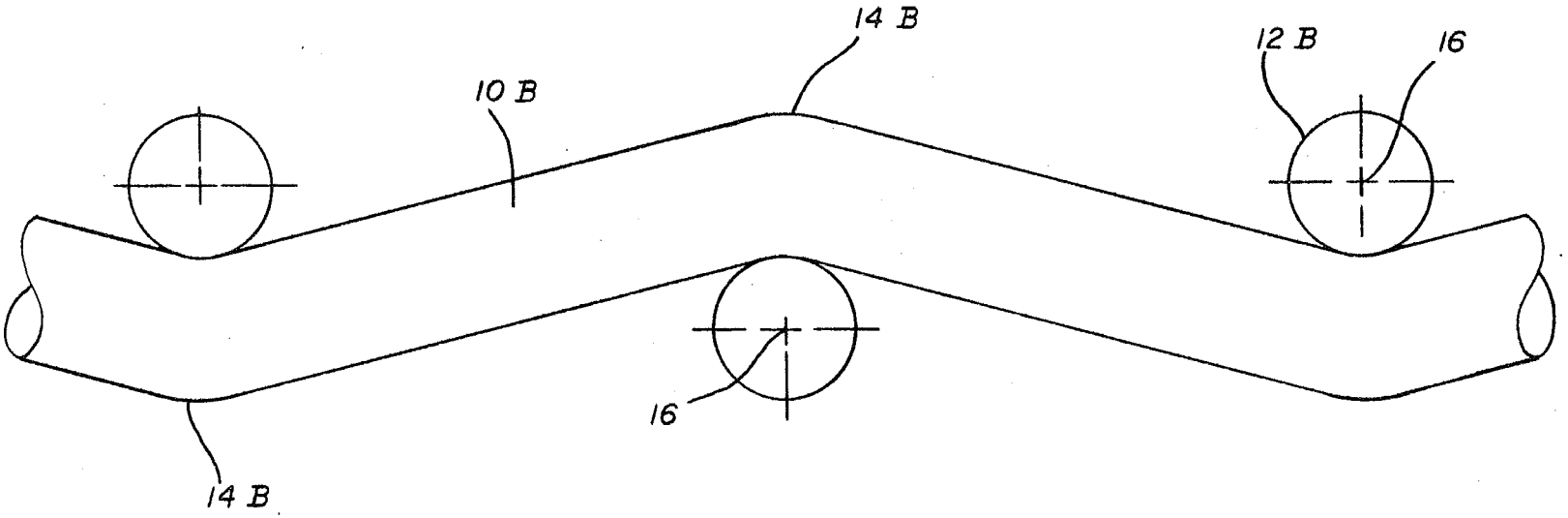
FIG 1B PRIOR ART
FIG. 1B is an end view of the screen shown in FIG. 1A wherein the shute wires are drawn more closely together.

FIG. 1B illustrates what happens when the axes 16 of the shute wires 12B are drawn closer together. The knuckles 14B on the warp wires 10B become sharper and extend further from the surfaces of the shute wires.

Figure 1C:
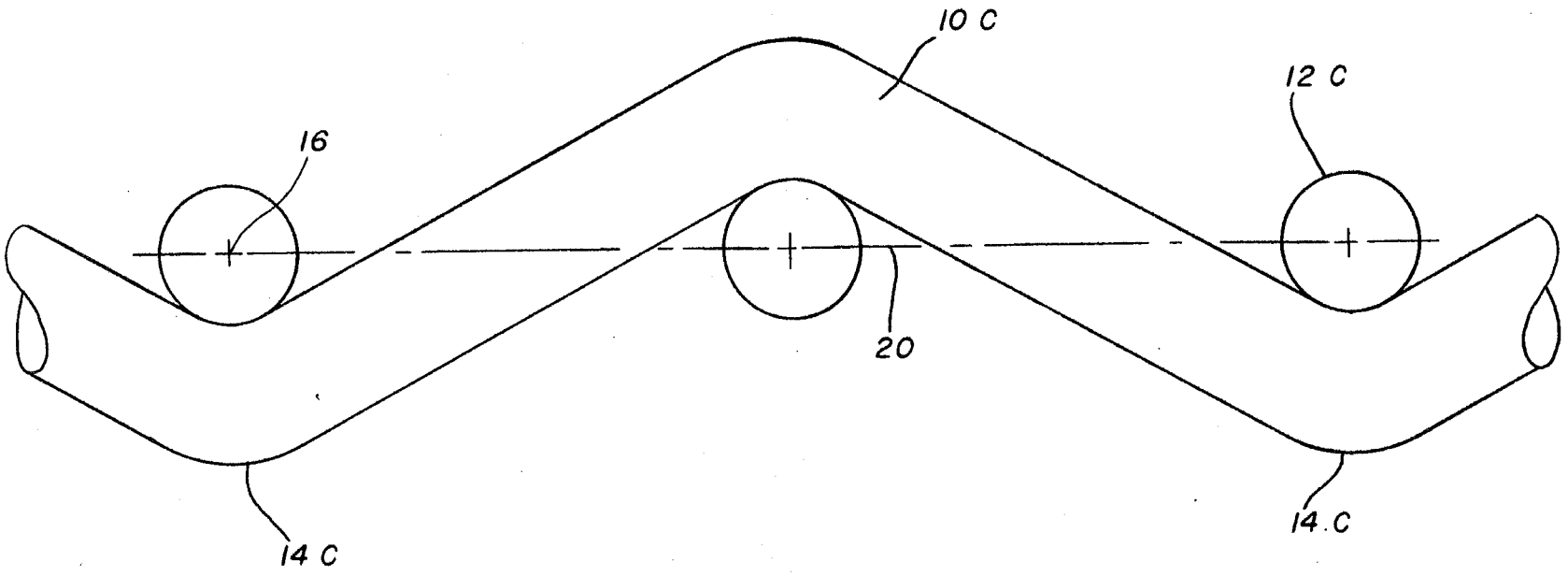
FIG. 1C PRIOR ART
FIG. 1C is an end view of the screen shown in FIG. 1A wherein the shute wires are drawn together so as to be in the same plane.

In FIG. 1C, the axes 16 of shute wires 12C have been drawn together such that they are all in a plane 20. The knuckles 14C of the warp wires 10C are sharper and extend even further than they do in FIG. 1B.

Figure 1D:
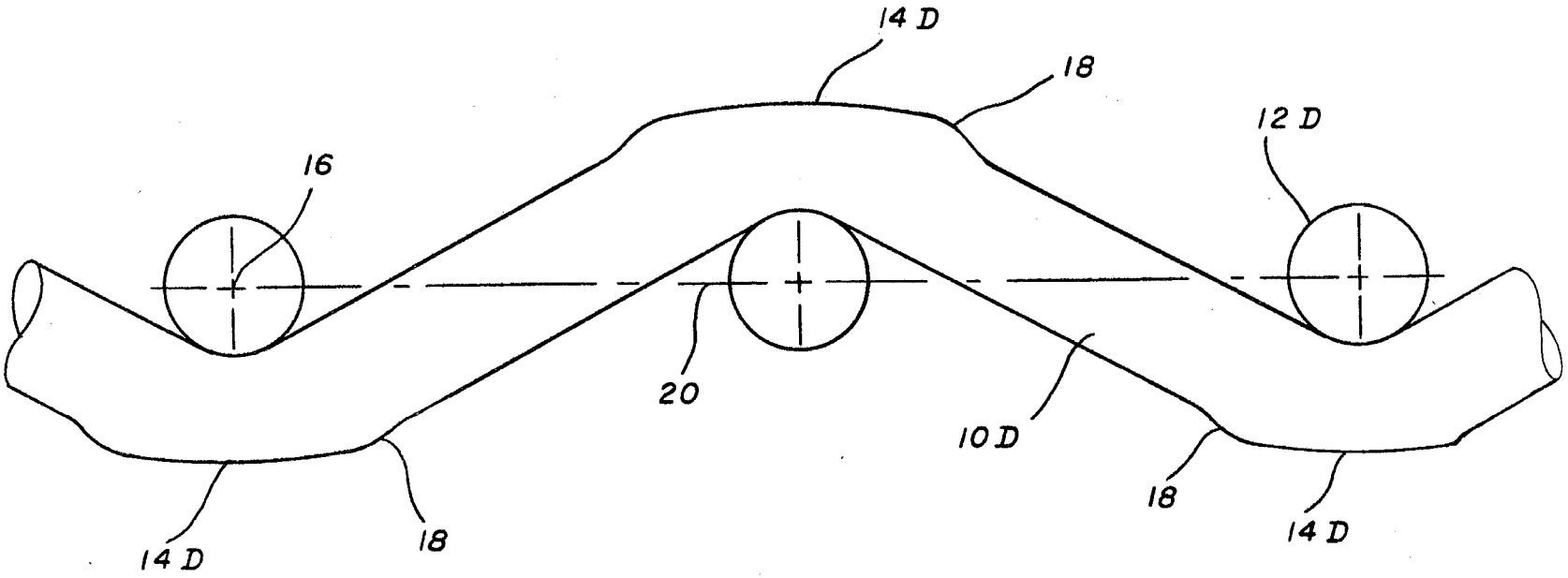
FIG. 1D is an end view of the screen of this invention wherein the warp wires are plastic and the shute wires are metal.

FIG. 1D illustrates the configuration of the wires in the most preferred embodiment of the texturing screen of this invention. The shute wires 12D are metal, such as bronze, and have their axes 16 aligned in a plane 20. The warp wires 10D are made of plastic. They are less stiff than the metal shute wires 12D and therefore their knuckles 14D tend to flatten out as they bend over the shute wires so that a slight bulge 18 is produced. Actually, the bulge 18 extends more laterally in the direction of the shute wire axis 16, but is shown in somewhat exaggerated form extending in the direction of wire 10D for purposes of illustration.

Figure 2:
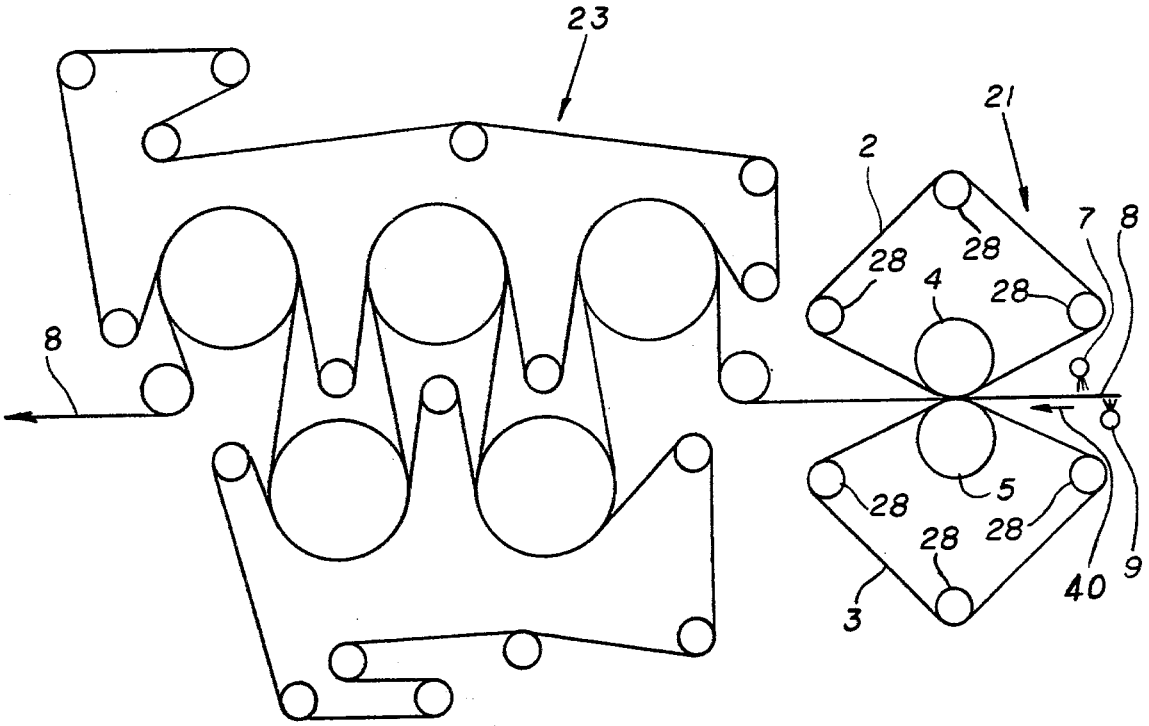
FIG. 2 is a side view of apparatus on a papermaking machine which utilizes a pair of opposing traveling screens, each being nipped between a press roll couple several times and providing the desired texturing on the interposed web.
Figure 2:
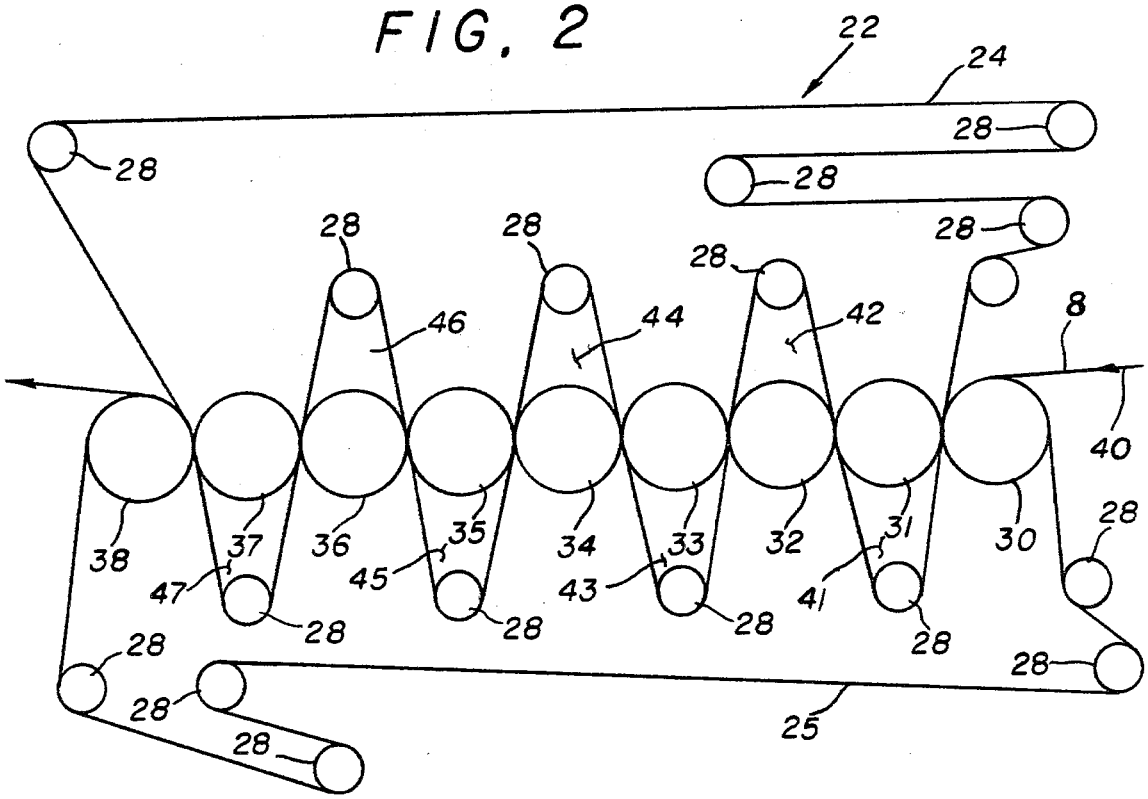

FIG. 2 illustrates the preferred embodiment of the apparatus in which a web 8 traveling in direction of arrow 40 is interposed between first upper and lower wire screens 2, 3, respectively, as it is received from the web forming section of a papermaking machine. At this point, the web is about 40%–50% or more moisture, particularly in view of the fact that many of the most modern tissue paper machine configurations do not include a press section. Sometimes, the press merely comprises a press roll nipping the web onto a dryer roll. However, if it is desired to raise the amount of moisture for any reason, moisture may be added by mist showers 7, 9. At this initial texturing station 21, which preferably is "on-machine" regardless of how the web is subsequently treated dry, the wet web is nipped once as it passes with screens 2, 3 between nip rolls 4, 5. The web then passes into standard dryer section 23 having a construction well known in the paper industry so it will not be described in detail. The paper is then dried to the desired dryness, such as "air dry" which is usually taken as meaning about 8% moisture, or less.

The web finally passes into the dry texturing station 22 where it is again interposed between a second upper and lower wire screen 24, 25, respectfully, as they all pass between a succession of nipped roll couples 30–38. Each of the wire screens 24, 25 travels in a continuous path guided by guide rolls 28. Immediately after each nipped press roll couple, the wire screens are guided apart so that gaps 41–47 are formed between the press stations as the screens separate from the web 8. This permits the knuckles on both screens to bear against the web at a slightly different location as they all pass through the next succeeding nip in its path through the texturing apparatus. By being repositioned slightly in their locations against the web surface as they pass through each successive nip, the knuckles on the screens operate against all areas of the web on both sides to thoroughly work and deform virtually all of the fibers against the interstices in the opposing screen. The web contacts a roll surface at all times and is thereby supported as it is being textured. While applying the knuckles of the screens at slightly different locations is desirable when texturing tissue paper, it isn't absolutely necessary.

Surprisingly, I have found that utilizing only one traveling screen to bear against the web as they pass between a nipped roll couple does not produce an acceptably textured web when the web is supported on a rubber surface, such as a rubber covered roll. The reason is that in order to achieve the desired softness, the web must be nipped so many times that its strength becomes too low for consumer acceptance. In some cases, the bulk then becomes unacceptably low. However, in the initial nip done while the web is wet, the use of one or two screens is not as important and the use of one screen for the wet nip is acceptable.

Naturally, such relative terms as "softness" and "unacceptably low" are subjective in nature and, accordingly, for purposes of comparison, I have selected a standard for acceptable values of bulk, strength and softness.

Bulk is measured in $cm^3/g$ and may vary in paper tissue webs from about 5 $cm^3/g$ to about 17 $cm^3/g$. My goal is to have a standard of about 5.5 $cm^3/g$ or more.

The strength of the tissue paper web is measured in terms of length in meters of a web that will support its weight without breaking. Low lengths indicate a web that is weaker since it will break under its own weight at a given length whereas a stronger web will not. For strength, my goal is a standard of about 200 meters or greater breaking length. It is interesting to note that breaking length strength has a practical lower limit. In toilet tissue and household paper toweling, the perforations in the web require the breaking length strength of the unperforated web to be greater than the strength of the perforated roll or the web will tear either during the converting process in the paper mill or when the consumer attempts to separate a sheet from the roll. Thus, if the breaking length of the perforated web is 200 meters, then the breaking length of the unperforated web will have to be greater than 200 meters.

Softness is perhaps the most subjective and difficult quality of a paper web to measure. In order to standardize the comparisons of softness (web stiffness) in paper webs, a commercially available instrument called a Handle-O-Meter, or HOM, has been developed. It measures the force in grams of the sliding friction required to drag a web over a sharp edge. My goal for tissue paper is a standard of about 25–35 grams or lower on the HOM. The lower the reading, the softer the web.

Incidentally, these goals for bulk, strength and softness result in a tissue paper web that compares very favorably with commercially available tissue paper products which are manufactured using either the common Yankee dryer/doctor apparatus or an off-machine arrangement utilizing engraved rolls.

Figure 3A:
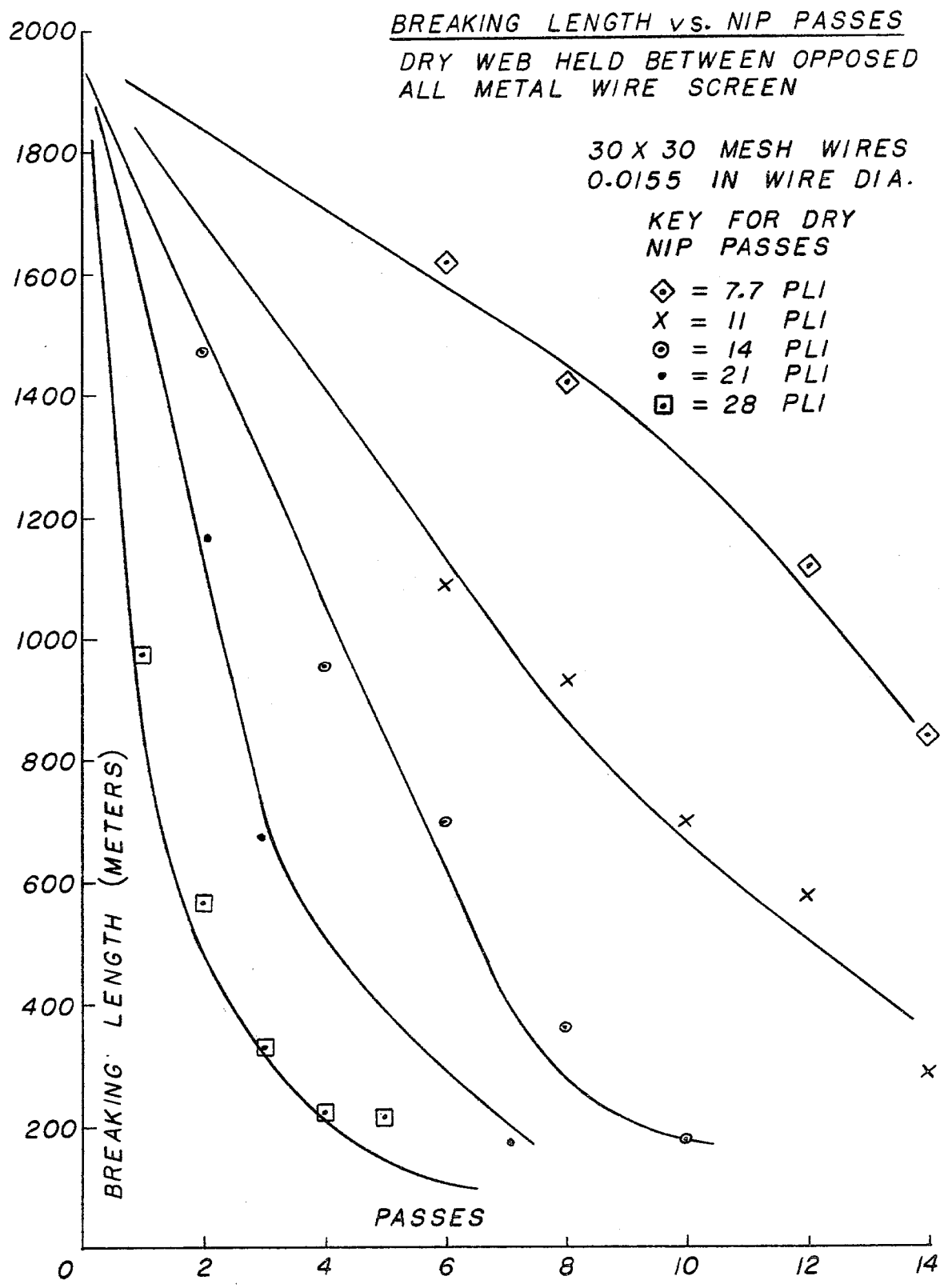
FIG. 3A is a graph plotting web breaking length against the number of passes of a dry tissue web held between a pair of all-metal wire screens as they travel through a press nip at different nip loading.
Figure 3B:
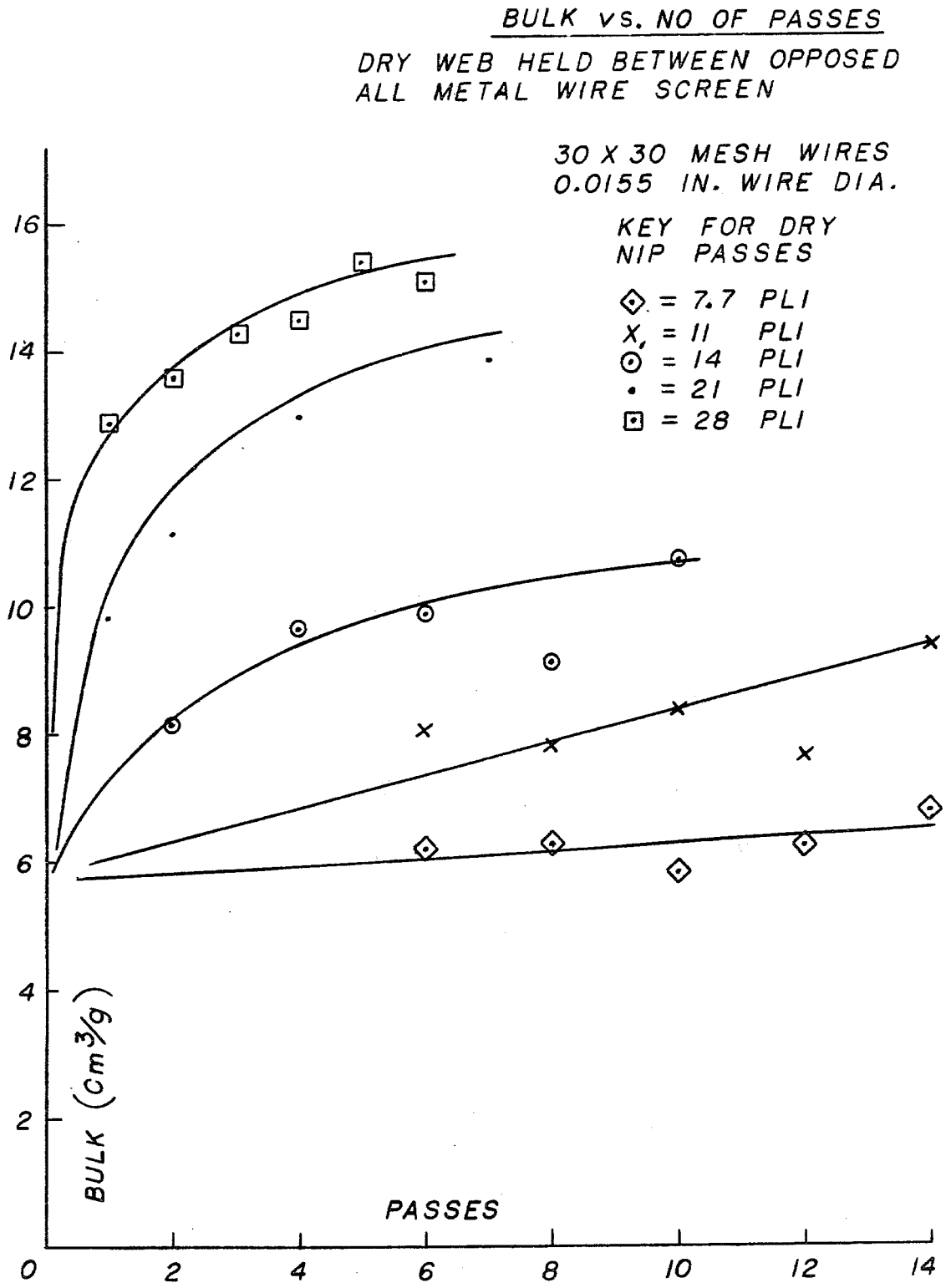
FIG. 3B is a graph plotting web bulk against the number of passes of a dry tissue web held between the same pair of screens as they travel through a press nip at different nip loadings.
Figure 3C:
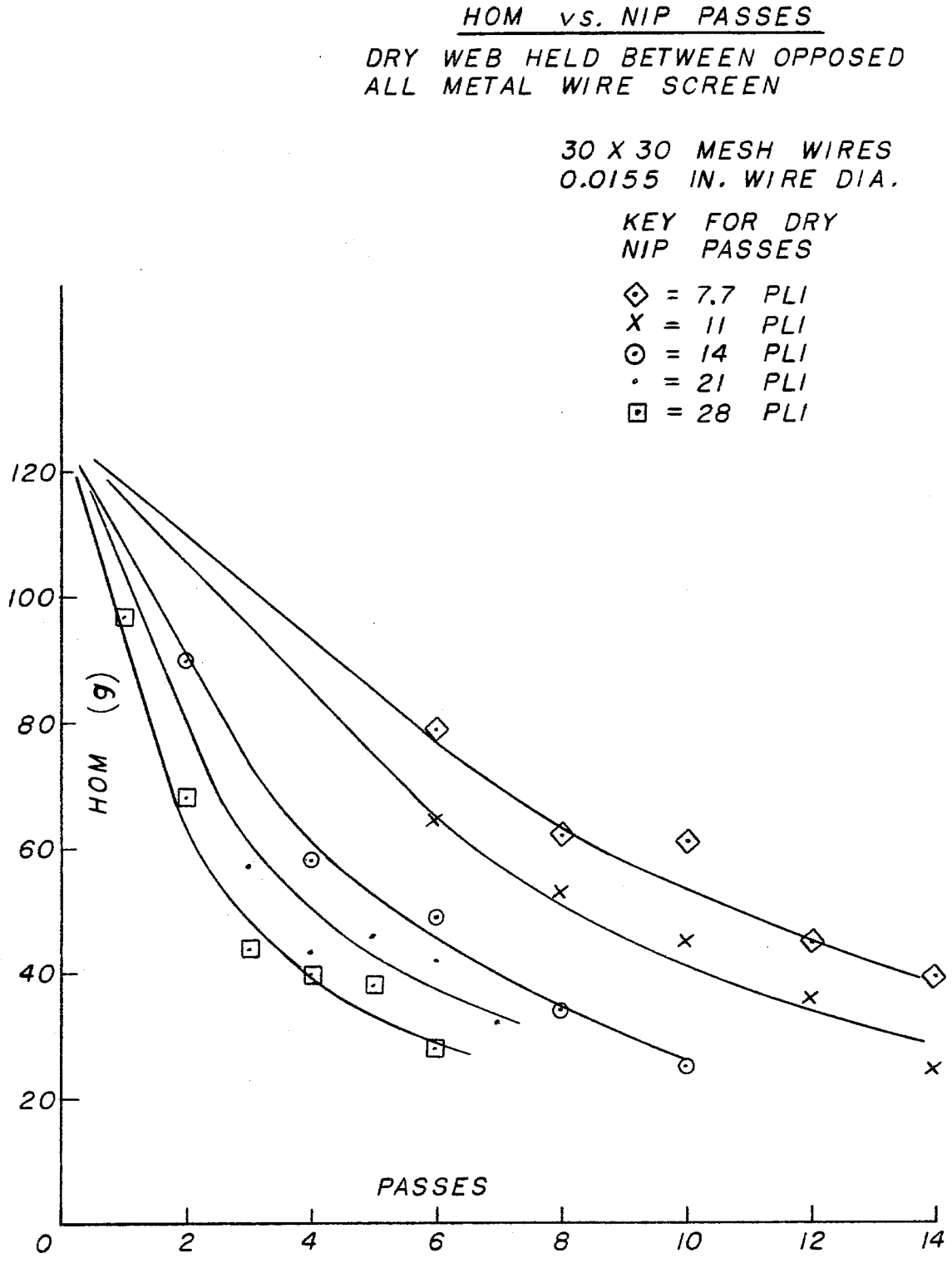
FIG. 3C is a graph plotting web softness (HOM) against the number of passes of the same dry tissue web held between the same screens as in FIG. 3A.

Referring now to FIGS. 3A, 3B and 3C, a web was dried completely and then its strength (breaking length) bulk and softness were measured as a function of the number of passes of the dry web between a pair of nipped rolls while held between a pair of opposed metal wire screens. The webs were not first textured once while wet. In FIG. 3A, it is seen that the web strength decreases with each pass through a nip from the very first nip. Further, the web strength also decreases with increasing nip load from the very first nip. In FIGS. 3B and 3C, it is seen that web bulk and softness increase with each pass through the nip and with increasing nip load.

Figure 4A:
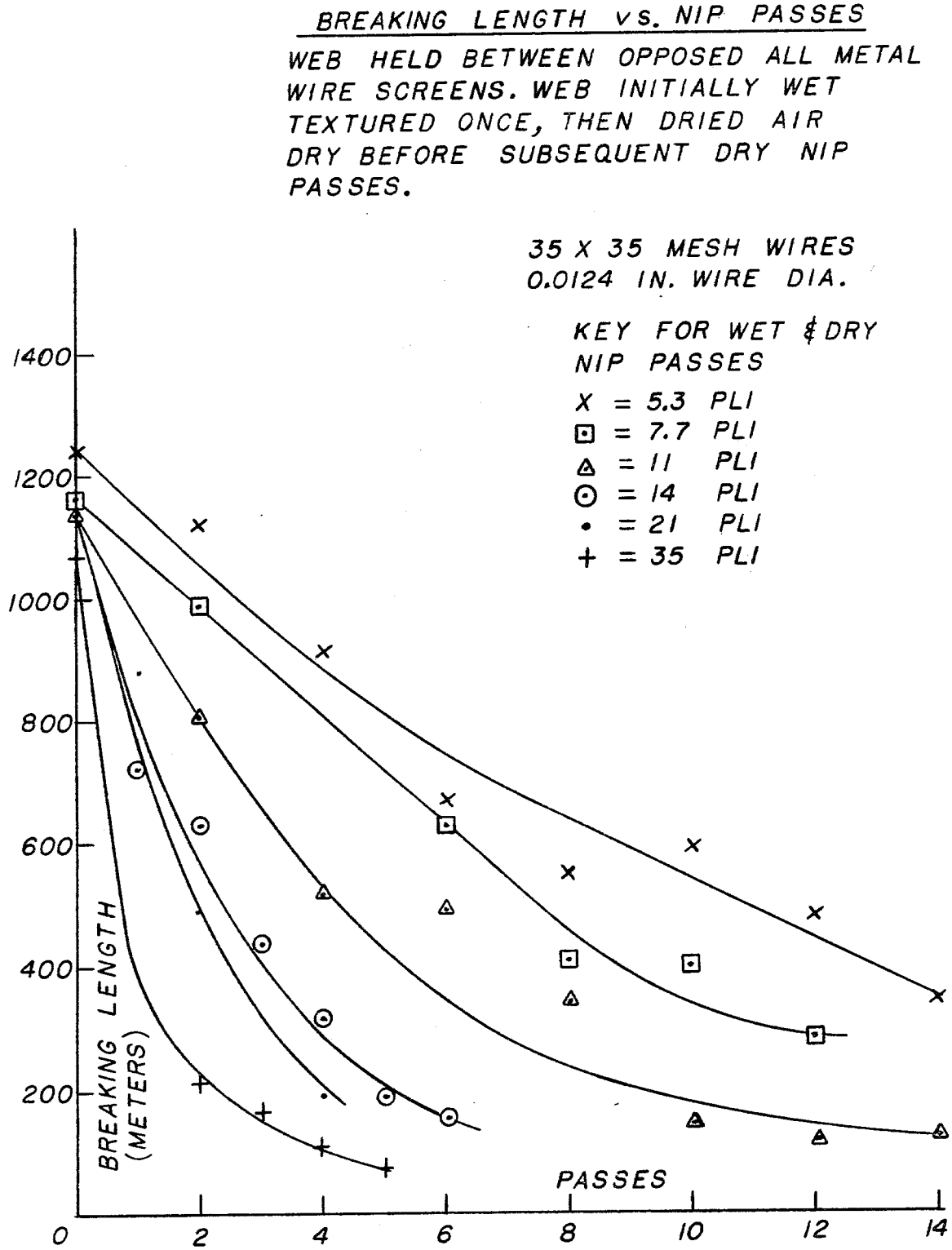
FIG. 4A is a graph plotting web breaking length against the number of passes of a tissue web that has been passed through a pair of nipped rolls while between a pair of all-metal wire screens once while wet and then several more times after it has been dried.
Figure 4B:
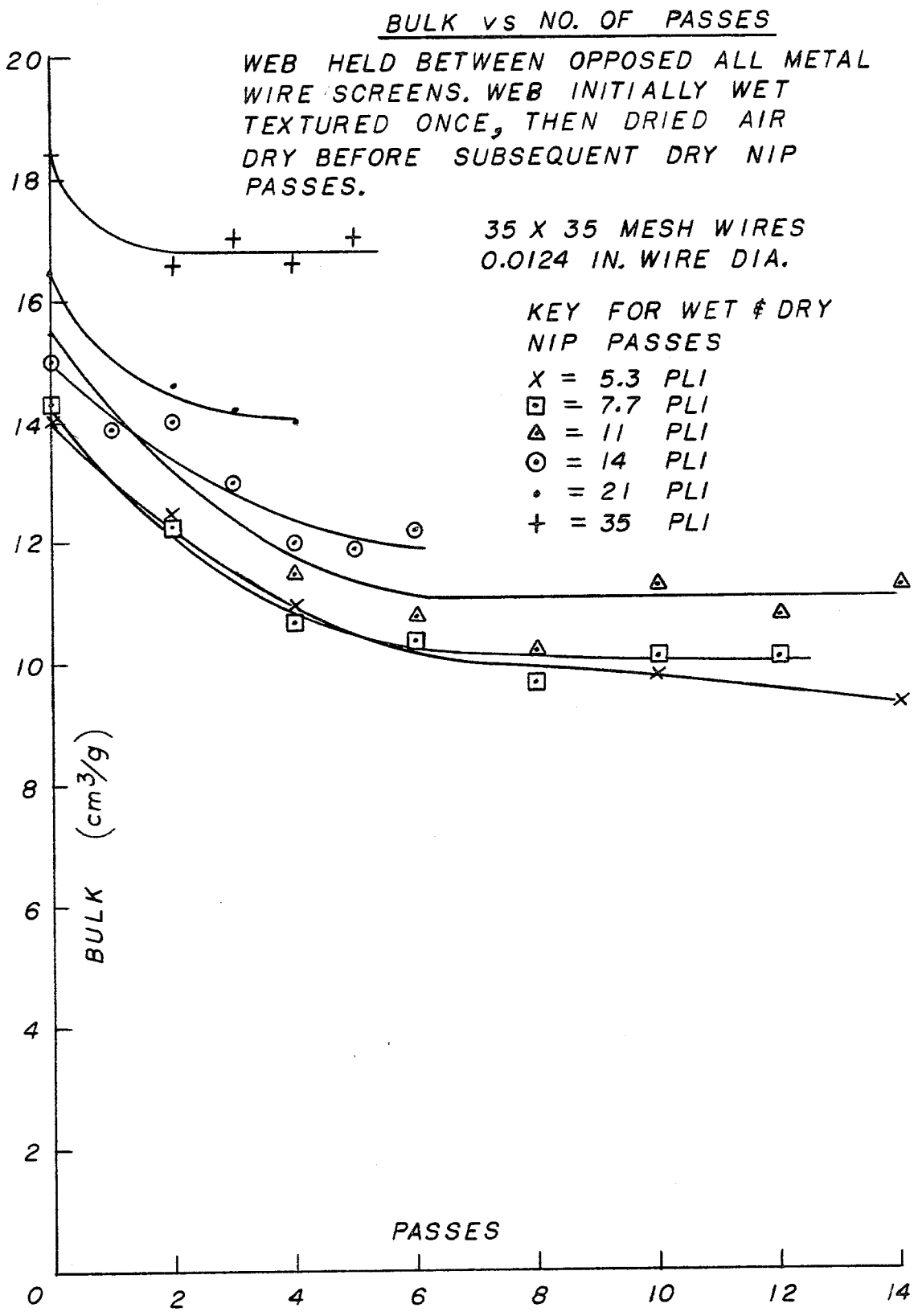
FIG. 4B is a graph plotting web bulk against the number of passes of the tissue web under the same conditions as in FIG. 4A.
Figure 4C:
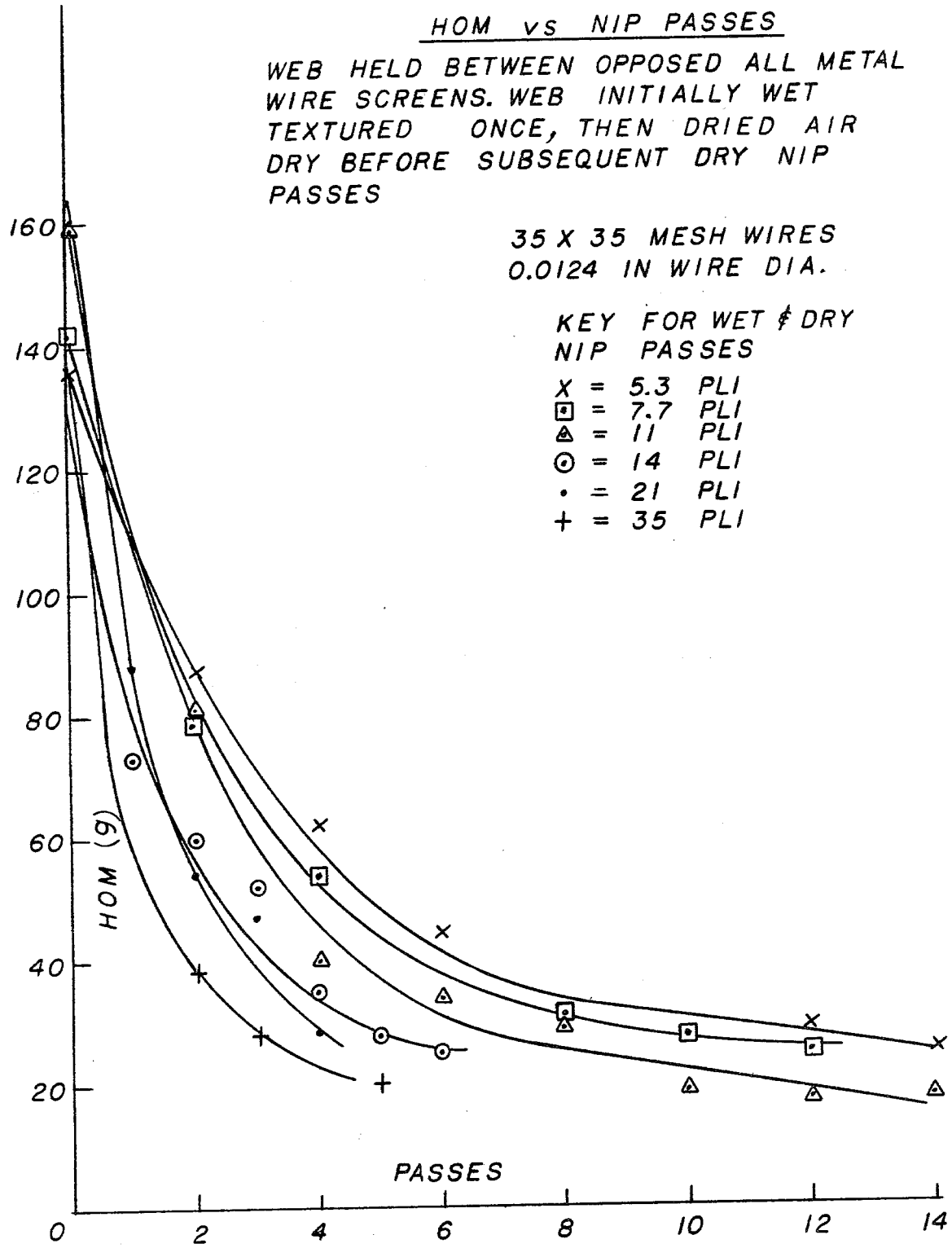
FIG. 4C is a graph plotting web softness (HOM) against the number of passes of the tissue web under the same conditions as in FIG. 4A.

In FIGS. 4A, 4B and 4C, the strength, bulk and softness of a paper tissue web which has first been passed through a nip between a pair of opposed all-metal wire screens while wet and then dried air dry before passing it through succeeding nips between the all-metal wire screens several times at the same nip pressure as used in the wet nip. In other words, for an initial wet nip of 7.7 PLI, the subsequent multiple nip passes of the dry web are also at 7.7 PLI and likewise for the other nip pressures. As shown in FIG. 4A, even after the web has been run through 14 nips of a nip loading of 7.7 PLI (pounds per lineal inch), the breaking length is greater than 200 meters. Similarly, FIG. 4B illustrates that the bulk of the web decreases as the number of nips increase, but in all cases is above the desired goal. In FIG. 4C, it is seen that the softness of the web decreases rapidly at first with increasing nips and thereafter more gradually. At nip loadings of about 7.7 PLI or less for about 8–14 passes, the softness falls within the range of 25–35 HOM.

Figure 5A:
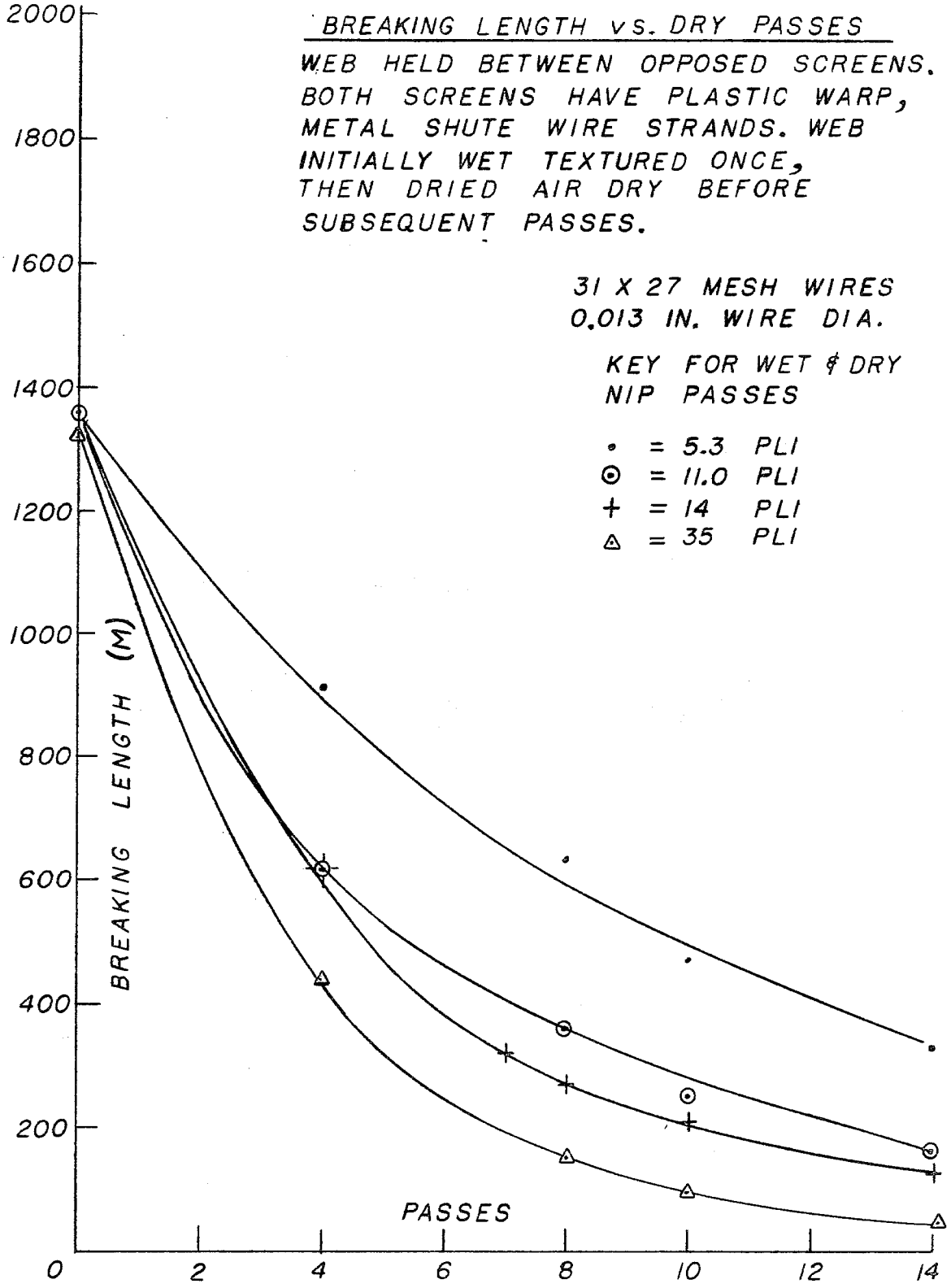
FIG. 5A is a graph plotting breaking length against the number of passes of a tissue web that has been passed through a pair of nip rolls while interposed between a pair of screens having plastic warp wires and metal shute wires once while wet and then several more times at different nip loadings after it has been dried.
Figure 5B:
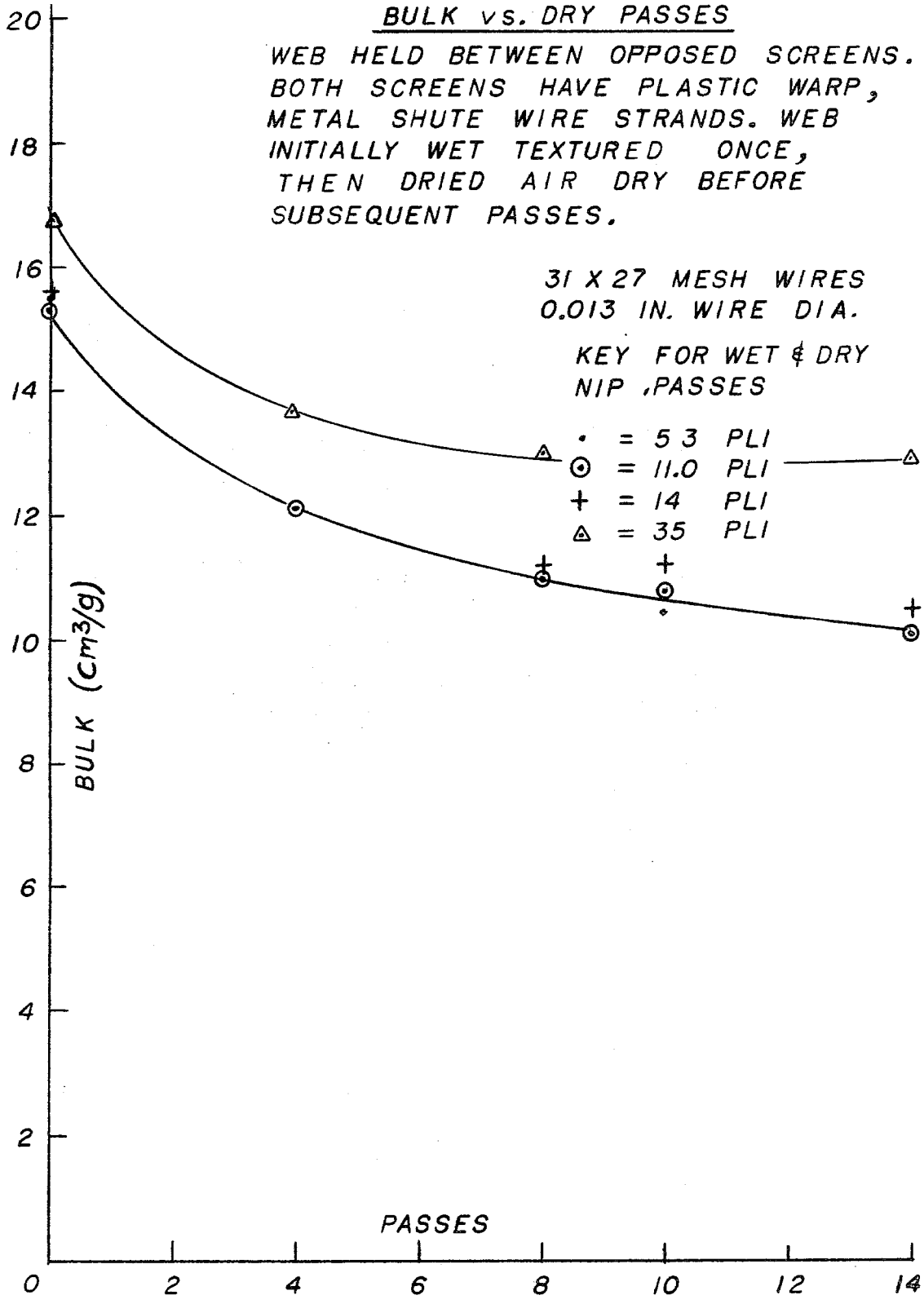
FIG. 5B is a graph plotting web bulk against the number of passes of a tissue web under the same conditions as in FIG. 5A.
Figure 5C:
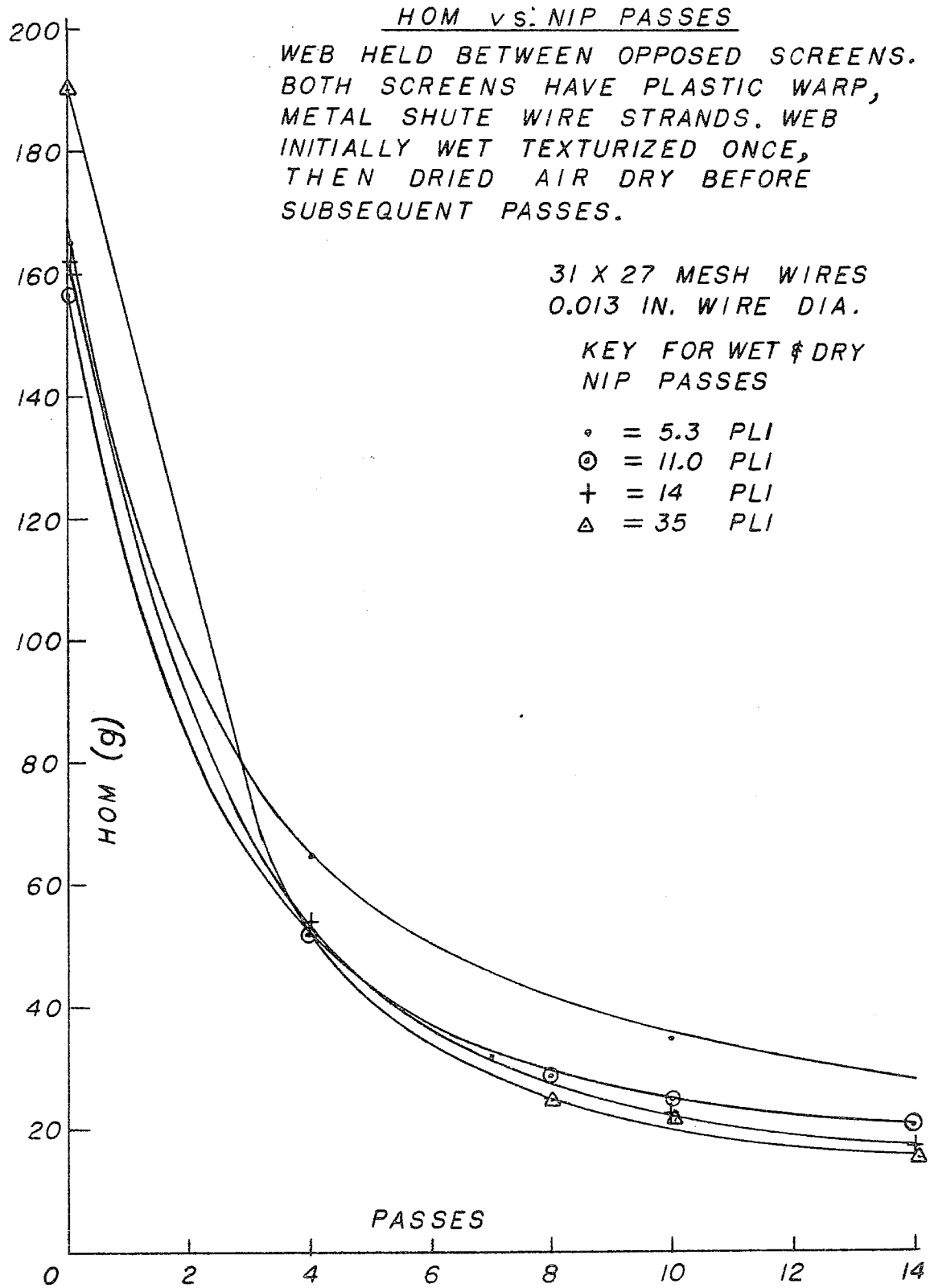
FIG. 5C is a graph plotting web softness (HOM) against the number of passes of a tissue web under the same conditions as in FIG. 5A.

FIGS. 5A, 5B and 5C illustrate the results of a web textured utilizing the composite metal/plastic wire screen of this invention. A web is interposed between a pair of screens wherein the warp wire strands are plastic and the shute wire strands are metal in each screen. Both screens with the interposed web are then passed between a plurality of nipped rolls fourteen times at different nip loadings, expressed in pounds per lineal inch (PLI), to produce three sets of four curves each for each web parameter being measured (i.e. breaking length, bulk and softness).

The results of these curves should be viewed in conjunction with the curves in FIGS. 4A, 4B and 4C and, to a lesser degree, with FIGS. 3A, 3B and 3C. Specifically in this regard, it is noted that the strength of the web which is dried before being passed through a nip, is higher (FIG. 3A) than a web which has been run through a nip first while it is wet (FIGS. 4A or 5A), but the strength of the web initially wet textured is also acceptable. In the curves in FIGS. 4 and 5, it is seen that the strength and bulk of the tissue webs textured with either the all-metal wire screens or the composite plastic/metal wire screens achieves the goals at lighter nip loadings than the dry textured web (FIGS. 3A–C) for as many nip passes. Conversely, generally speaking, the goals are achieved on the initially wet textured web in fewer passes at the same nip load.

For example, at a nip loading of 5.3 PLI at 10 nip passes, the bulk is about 9.7 $cm^3/g$ using the all-metal wire screens (FIG. 4B) and about 10.6 $cm^3/g$ using the plastic/metal composite wires (FIG. 5B). In fact, the bulk of the web initially exceeds the desired goal of 5.5 $cm^3/g$ at any combination of nip loadings and passes.

Generally, the more nip passes used the lighter the nip loading can be for a given number of passes to produce the desired strength, bulk and softness. In this regard, it is noted that at less than about 3 or 6 nip passes, depending on the wire, the softness (FIGS. 4C, 5C) of the web is not satisfactory unless very high nip loadings (i.e. above about 35 PLI) are used on the air dry web. Such high nip loadings greatly reduces the strength of the web to below acceptable levels at the same range of nip passes. Further, I have found that the web may suffer from tears and punctures, depending on its thickness and stock composition, when it is dry textured at nip loadings much above about 35 PLI regardless of the number of passes.

The single nip of wet texturing is not as sensitive to nip loading. In fact, the initial wet web texturing nip may be applied at a different, higher nip loading than subsequent dry nip passes. However, at wet web nip loadings above about 50 PLI, the corresponding increase in web bulk begins to rapidly diminish, so a wet web initial nip load of about 50 PLI represents a practical upper limit.

Therefore, the preferred operating conditions on a web initially wet textured and then air dried are a nip loading combination in the range of about 5 PLI to about 50 PLI initial wet web nip load and about 5 PLI to about 35 PLI dry nip load at a range of about 3 to about 14 passes of the air dried web. These conditions produce textured tissue webs having the desired combination of strength, softness and bulk and which compare with tissue webs made on a Yankee machine wherein the softness is imparted by doctoring the web off the Yankee dryer. This invention does not require or utilize a Yankee dryer or a doctor to texture the web and the complete texturing process can be performed on the papermaking machine at the speed the paper is made. Finally, the composite plastic/metal wire screen accomplishes the objectives while providing improved screen life due to the ability of the plastic warp wires to withstand more cyclic deformations than metal wires.

While a variety of mesh sizes provide satisfactory results, the preferred mesh ranges from about 18×18 to about 50×50 with a wire diameter of about 0.010–0.020 inch, preferably about 0.013–0.018 inch. A preferred specific plastic/metal composite screen is an 31×27 plastic warp/metal shute with the wires being about 0.013 inch in diameter. In the paper industry, such mesh designation as this W×S format refer to the warp wire spacing, wires/inch×the shute wire spacing, wires/inch.

Various equivalent products and structures, not necessarily described herein but which are readily discernable to those skilled in the art, are contemplated and intended to be within the scope of this invention. For example, the "non-woven fabric" contemplates light weight melt-blown fiberous webs as well as the various grades of tissue, such as facial, sanitary, napkin and towel paper. Also, the drying function can be provided by ordinary cylindrical dryers, transpiration drying arrangements or other means. Finally, while the curves in FIGS. 3, 4 and 5 are drawn with each curve of dry nip passes made for the same nip pressure for a range of number of passes for clarity, it is contemplated that varying the nip pressure from pass to pass through the nipped rolls within the range of dry nip pressures stated is within the scope of the invention. Thus, for example, the web in FIG. 4A might be initially wet textured once at 14.0 PLI and then dry textured for 9 passes through nipped rolls at nip pressures varying from between about 5.3 PLI to about 11.0 PLI.

What is claimed is:

1. A method of texturing a non-woven web whereby the web attains a breaking length strength of about 200 meters or more, a bulk of about 5.5 $cm^3/g$ or more and a softness of about 25–35 g or less, HOM, comprising the steps:

1. passing the web in contact with at least one texturing screen member between a pair of nipped rolls when the web has a moisture content of between about 40%–80% to wet texture the web;

2. drying the web to substantially air dry;

3. passing the web between a pair of nipped rolls while interposed between a pair of texturing wire screens a plurality of times between about 3–14 passes at a roll nip pressure each time less than about 35 PLI.

2. The method as set forth in claim 1, wherein:

the nip pressure in the initial nip while the web is wet is less than about 50 PLI;

the pressure of the nipped rolls through which the web passes after it has been dried ranges from about 5 PLI to about 35 PLI.

3. The method as set forth in claim 1, wherein:

the web in step (1) is passed between the pair of nipped rolls while interposed between a pair of screens, the roll nip pressure being between about 5 PLI and 50 PLI.

4. The method as set forth in claim 1, further including the step of:

separating at least one screen from the web in step (3) between roll nips.

5. The method as set forth in claim 1, wherein:

at least one of the pair of texturing screen members comprises a composite screen having metal warp wires and plastic shute wires.

6. The method as set forth in claim 1, wherein:

the web in step (3) is supported between successive nips.

7. Apparatus for texturing an initially moist non-woven web comprising, in combination:

a first pair of nipped rolls;

at least one first screen member for traveling through the first pair of nipped rolls once while in contact with the web when the web has a moisture content of between about 40% and 80% to thereby wet texture the web;

drying means for receiving the wet textured web and drying it to substantially air dry;

a plurality of nipped roll couples for successively receiving the dried web between their nips;

at least one second texturing screen arrayed to pass successively between the nips of the plurality of roll couples from about 3 to about 14 passes together with the dry web.

8. Apparatus for texturing a non-woven web as set forth in claim 7, further including:

means separating each of the second texturing screen or screens from the web between successive nips whereby the screen or screens re-engage the web at a slightly different location as they travel through the next nip together, whereby the web is textured and attains the desired degree of strength, softness and bulk.

9. Apparatus for texturing a non-woven web as set forth in claim 7, wherein:

the first and second texturing screens have a mesh size of from about 18×18 to about 50×50 with a wire diameter of from about 0.010 inch to about 0.020 inch.

10. Apparatus for texturing a non-woven web as set forth in claim 7, wherein:

at least one of the second texturing screen or screens comprises warp wires of plastic and shute wires of metal.

11. Apparatus for texturing a non-woven web as set forth in claim 10, wherein:

the composite metal plastic texturing screen or screens are about 31×27 mesh size with wire of about 0.013 inch diameter.

* * * * *